US006413110B2

(12) United States Patent
Keller

(10) Patent No.: US 6,413,110 B2
(45) **Date of Patent: *Jul. 2, 2002**

(54) ZERO INSERTION FORCE SOCKET

(75) Inventor: Rex W. Keller, Glendale, AZ (US)

(73) Assignee: FCI Americas Technology, Inc., Reno, NV (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/387,689

(22) Filed: Aug. 31, 1999

(51) Int. Cl.[7] ..... H01R 4/50
(52) U.S. Cl. ..... 439/342; 439/259
(58) Field of Search ..... 439/342, 259, 439/266, 876, 260, 261, 262, 263, 264, 265, 268, 409, 410

(56) References Cited

U.S. PATENT DOCUMENTS

| | | | | |
|---|---|---|---|---|
| 1,724,729 A | | 8/1929 | Ruttenberg et al. | |
| 2,526,869 A | | 10/1950 | Hubacker | 173/269 |
| 3,351,889 A | * | 11/1967 | Lawlor et al. | 439/410 |
| 3,609,642 A | | 9/1971 | Norden | 339/95 D |
| 3,676,832 A | | 7/1972 | Judge et al. | 339/75 M |
| 3,937,548 A | | 2/1976 | Dittmann | 339/95 D |
| 4,062,617 A | | 12/1977 | Johnson | 339/75 M |
| 4,082,399 A | | 4/1978 | Barkhuff | 339/75 M |
| 4,331,371 A | | 5/1982 | Ichimura et al. | 339/74 R |
| 4,468,072 A | | 8/1984 | Sadigh-Behzadi | 339/74 R |
| 4,708,417 A | | 11/1987 | Woertz | 439/828 |
| 4,744,768 A | * | 5/1988 | Rios | 438/262 |
| 4,950,980 A | | 8/1990 | Pfaff | 439/296 |
| 5,059,135 A | | 10/1991 | Matsuoka et al. | 439/268 |
| 5,069,638 A | | 12/1991 | Schalk | 439/439 |
| 5,102,346 A | | 4/1992 | Soes | 439/268 |
| 5,116,238 A | | 5/1992 | Holloman | 439/441 |
| 5,154,626 A | | 10/1992 | Watson | 439/268 |
| 5,213,530 A | | 5/1993 | Uratsuji | 439/268 |
| 5,489,217 A | | 2/1996 | Scheitz et al. | 439/342 |
| 5,597,318 A | | 1/1997 | Townsend | 439/342 |

* cited by examiner

*Primary Examiner*—P. Austin Bradley
*Assistant Examiner*—Ross Gushi
(74) *Attorney, Agent, or Firm*—Woodcock Washburn LLP

(57) ABSTRACT

A socket for connecting an electrical component to a circuit substrate is disclosed. The electrical component has a terminal extending along a terminal axis therefrom. The socket includes a base, a contact secured to the base to electrically connect the terminal to the circuit substrate, a cover attached to the base, and an actuator. The contact includes a beam portion elongated along a beam axis, and a contact mating portion flexibly connected to an end of the beam portion and defining a contact plane at an angle with the beam axis. The contact mating portion has a contact aperture therein to receive the terminal. The cover has a lead-in aperture for receiving the terminal and allowing the terminal to enter the contact aperture. The actuator is operatively coupled to the contact, for causing the contact mating portion to rotate and to engage the terminal.

9 Claims, 6 Drawing Sheets

ZERO INSERTION FORCE SOCKET

FIELD OF THE INVENTION

This invention relates to electrical connectors. More particularly, the invention relates to zero insertion force pin grid array sockets for use in connecting an integrated circuit to a circuit substrate.

BACKGROUND OF THE INVENTION

A pin grid array (PGA) socket is used for connecting an integrated circuit (IC), such as an application-specific integrated circuit (ASIC), to a circuit substrate, such as a printed circuit board (PCB). PGA sockets typically comprise a base that supports a plurality of contacts, and a cover that includes a plurality of insertion holes. The base is mounted on the circuit substrate to form an electrical connection with circuits on the circuit substrate. The cover is attached to the base prior to assembly of the circuit substrate so that the lateral surfaces of the circuit substrate, base, and cover are stacked in a parallel arrangement.

Typical PGA socket covers have rows and columns of insertion holes. The exact number of insertion holes and the orientation of the insertion holes typically depends on the types of ICs to be connected to the circuit substrate. The rows and columns of insertion holes are spaced on interstitial centers calculated to accommodate the pin densities of the ICs. Currently available ICs can have pins spaced on about 0.05-inch centers or less.

Historically, when it was desired to connect an IC to a circuit substrate, the pins of the IC were forcibly inserted into the insertion holes of the cover and against the contacts to form an electrical connection between the pins of the IC and the electrically conductive contacts. It was found that the insertion force required to establish an adequate electrical connection is considerable and can lead to difficulty in installing and removing the IC. Moreover, the pins of the IC can be damaged easily as a result of its installation and removal.

Therefore, low insertion force (LIF) and zero insertion force (ZIF) PGA sockets have been developed to reduce the insertion forces needed to establish an electrical connection between the contacts and the pins. The covers of LIF or ZIF PGA sockets are typically attached to the base so that the cover is movable over the lateral surface of the base. An actuator or other mechanism for camming the cover over the surface of the base is included so that the contacts are deflected against the pins of the IC. The base cover can have contact support walls for supporting the individual contacts.

These LIF and ZIF devices, however, also can cause the pins of the ICs to be damaged. For example, as the cover moves over the surface of the base, the portion of the pins extending beneath the cover can be forced against the contacts. This can create a shear force and a moment which cause the pins to bend or to break. Additionally, the mating force between the contact and the pin can damage the pin since the pins themselves are not provided with any support in the mating region.

Therefore, there is a need for a ZIF PGA socket that can be used to connect an IC to a circuit substrate without causing the portion of the pins extending beneath the cover to be forced against the contacts, thus reducing the incidence of pin damage. Moreover, the ZIF PGA socket should be compatible with ICs having pins spaced on 0.05-inch centers or less.

SUMMARY OF THE INVENTION

According to the present invention, a socket for connecting to a circuit substrate an electrical component having a terminal extending along a terminal axis therefrom comprises a base, a contact secured to the base to electrically connect the terminal to the circuit substrate, a cover attached to the base, and an actuator.

The contact comprises a beam portion elongated along a beam axis, and a contact mating portion having a contact aperture therein to receive the terminal. The contact mating portion is flexibly connected to an end of the beam portion, and defines a contact plane at an angle with the beam axis. Preferably, this angle is about 90 degrees or less. The aperture through the contact mating portion can have a substantially circular cross-section, and the beam portion can have a substantially uniform cross-sectional area along a length thereof. The contact mating portion and beam portion can be integrally formed with one another by stamping, for example, from a sheet of electrically conductive material.

The cover is attached to the base and has a lead-in aperture for receiving the terminal and allowing the terminal to enter the contact aperture. The actuator is operatively coupled to the contact, for causing the contact mating portion to rotate and to engage the terminal.

The socket of the present invention can also include a deflection member extending from an inner surface of the cover proximate the lead-in aperture, for causing the contact mating portion to rotate. The deflection member can extend from the inner surface of the cover, for causing the contact mating portion to rotate relative to the terminal axis when the cover is moved toward the base. Alternatively, the deflection member can extend from the inner surface of the cover, for causing the contact mating portion to rotate relative to the terminal axis when the cover is moved along the base. The deflection member can also have an aperture through which the beam element extends, for causing the contact mating portion to rotate relative to the pin axis when the deflection member is moved relative to the beam element.

According to the present invention, a method of electrically connecting to a circuit substrate an electrical component having a terminal extending therefrom comprises providing a socket connector having a contact with a contact mating portion that has a contact aperture therethrough, and actuating the mating portion from an open position, in which the contact aperture freely accepts the terminal, to a closed position, in which an edge defining the contact aperture is in electrical contact with the terminal.

BRIEF DESCRIPTION OF THE DRAWINGS

The present invention will be better understood, and its numerous objects and advantages will become apparent by reference to the following detailed description of the invention, when taken in conjunction with the following drawings.

DETAILED DESCRIPTION OF PREFERRED EMBODIMENT

Figure 1:
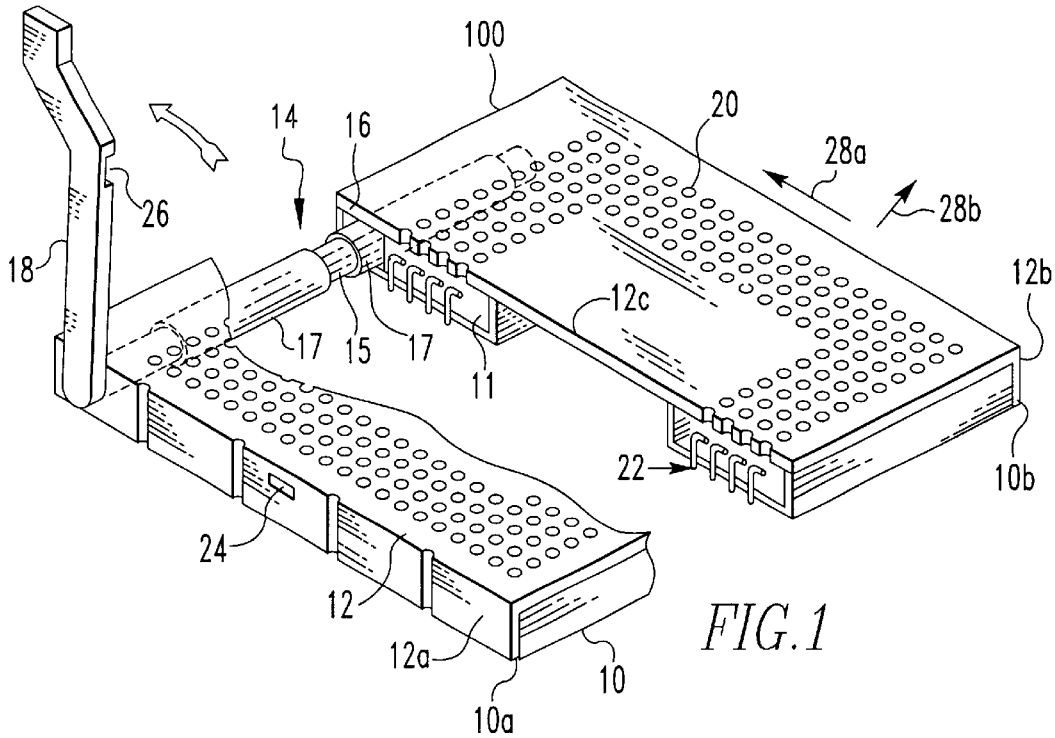
FIG. 1 shows a partial cross section of a pin grid array (PGA) socket according to the invention.

FIG. 1 shows a partial cross section of a pin grid array (PGA) socket 100 according to the present invention. A base 10 and a cover 12 are shown attached together. Preferably, the base 10 and cover 12 are made of plastic or other similar material so that the walls 10*a*, 10*b*, of the base and the walls 12*a*, 12*b* of the cover are sufficiently flexible to permit the walls 12*a* and 12*b* to be snapped over ridges (not shown) of the corresponding walls 10*a* and 10*b*, respectively, to secure the cover 12 to the base 10.

The base 10 and cover 12 cooperate to form an opening 16 through the PGA socket 100 in a plane perpendicular to the walls 10*a*, 10*b*, 12*a*, 12*b*. An actuator 14, such as a cam, is disposed through the opening 16 and connected to an actuator bar 18. The actuator bar 18 can be a cast part, or formed from wire. The actuator bar 18 can be rotated to cam the cover 12 over the lateral surface 11 of the base 10 and along the walls 10*a*, 10*b*. A notch 26 and a latch 24 are formed on the actuator bar 18 and the wall 12*a* of the cover 12, respectively, for use in latching the actuator bar 18 in place.

Preferably, the cast actuator 14 comprises one or more bearing surfaces 15 and one or more camming surfaces 17. The bearing surfaces 15 are substantially symmetrical about a central axis, while the camming surfaces 17 are eccentric. Thus, when the actuator bar 18 is lifted as shown in FIG. 1, the camming surfaces 17 rotate in a counter clockwise direction and engage portions of the walls of cover 12 that partially define opening 16. As a result, the cover 12 can be moved relative to the lateral surface 11 of the base 10. By forming the camming surfaces 17 with the appropriate eccentricity, cover 12 can be made to slide along the base 10 in the direction shown by arrow 28*a*, or to move slightly away from the base 10 in the direction shown by arrow 28*b*, or some combination of the two. It should be understood that actuator 14 can be configured in numerous ways to effect the necessary camming and that the actuator 14 shown in FIG. 1 is merely illustrative of an exemplary actuator 14 for camming the cover 12 over the base 10.

Figure 2:
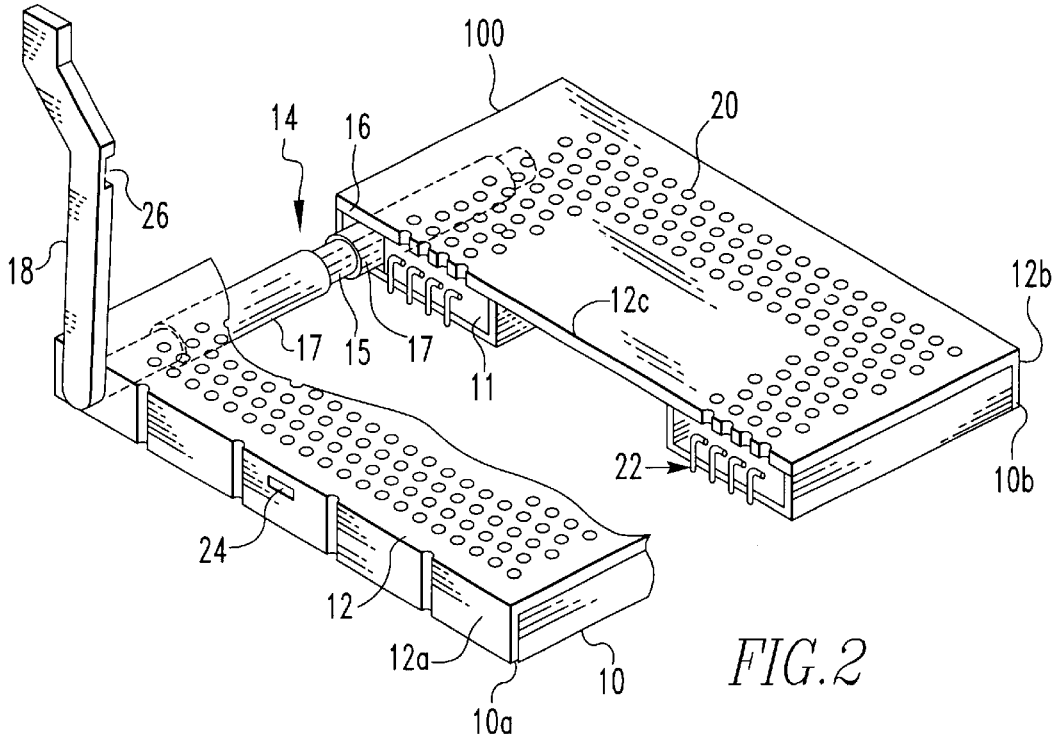
FIG. 2 shows an alternative embodiment of a PGA socket in which the rows and columns of insertion holes are interstitially arranged.

A plurality of electrically conductive socket contacts 22 are supported in the base 10 as shown in FIG. 1. The top surface of the cover 12 provides a plurality of tapered, lead-in apertures or insertion holes 20. The insertion holes 20 are generally arranged in rows and columns as shown in FIG. 1. In an alternative embodiment, as shown in FIG. 2, the insertion holes can be interstitially arranged (e.g., the rows and columns of the insertion holes 20 can be staggered). In general, the insertion holes 20 can be arranged in any arrangement corresponding to the arrangement of pins on the electronic component to be received into the PGA socket 100. The insertion holes 20 should be dimensionally large enough to receive the pins of the electronic component without measurable insertion force. Preferably, the plurality of contacts 22 are arranged such that each insertion hole 20 corresponds to one contact 22; although, in some instances, there may be fewer contacts 22 than insertion holes 20. As shown in FIGS. 1 and 2, a central area 12*c* of cover 12 can be devoid of insertion holes 20. This configuration of insertion holes is purely exemplary and, in alternate embodiments of a PGA socket according to the present invention, insertion holes 20 can be distributed throughout cover 12 in any arrangement.

Figure 3A:
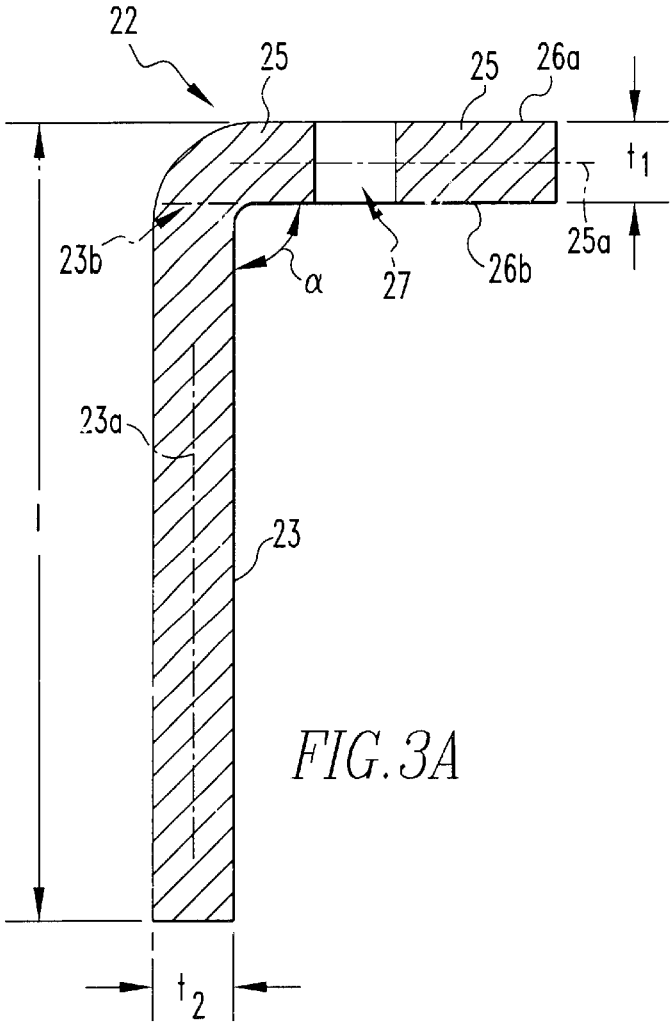
FIG. 3A provides a detailed cross-sectional view of a contact according to the invention in an open PGA socket.
Figure 3B:
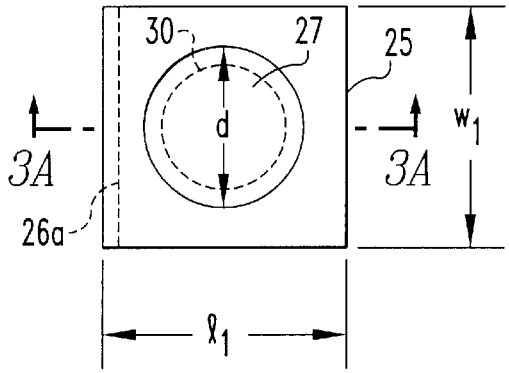
FIG. 3B provides a detailed top view of a contact according to the invention in an open PGA socket.

FIG. 3A provides a detailed cross-sectional view, and FIG. 3B provides a detailed top view, of a contact 22 according to the present invention. As shown, contact 22 can have an "L" shape, with a beam portion 23 elongated along, and preferably symmetric about, a beam axis 23*a*. Contact 22 also comprises a contact mating portion 25 that is flexibly connected to an end 23*b* of the beam portion 23 and defines a contact plane 25*a* that forms an angle, a, with the beam axis 23*a*. Preferably, beam portion 23 and contact mating portion 25 are integrally stamped and formed from a single sheet of conductive material, and angle, a, is approximately 90° before insertion of an electrical component into PGA socket 100. Contact mating portion 25 has a contact aperture 27 extending from a first face 26*a* of contact mating portion 25 to a second face 26*b* opposite the first face 26*a*. The size and shape of the aperture 27 is selected to be slightly larger than the cross-sectional area of an IC pin that is to be received into the aperture 27. Preferably, aperture 27 has a circular cross-section having a diameter, d, to receive a pin 30 having a round cross-section, for example.

As discussed above, contact 22 is preferably stamped and formed from a sheet of metal. Thus, in a preferred embodiment, a thickness $t_1$ is the same as a thickness $t_2$ of beam portion 23. The thicknesses $t_1$, $t_2$ could be less than about 0.005 inches; more preferably of about 0.004 to about 0.005 inches. Alternatively, contact 22 could have different thicknesses $t_1$, $t_2$.

Preferably, the beam portion 23 has a length, l, of less than about 0.100 inches, and more preferably of about 0.020 to about 0.100 inches. Preferably, the contact mating portion 25 is rectangular and has a width $w_1$ perpendicular to beam portion 23, and a length $l_1$, both of which are less than about 0.030 inches. Preferably, the beam portion 23 has a uniform, more preferably rectangular, cross-sectional area along its length, l, and has a width equal to the width $w_1$ of the contact mating portion 25, preferably of less than about 0.030 inches. It is expected that many electronic components, such as integrated circuits, will provide pins that are spaced on less than 0.100-inch centers, and most likely on about 0.04 to about 0.05-inch centers. Thus, in a preferred embodiment, the contacts are stamped on about 0.04- to about 0.05-inch centers from a plate of an electrically conductive material, such as beryllium copper, having a thickness of about 0.004 to about 0.005 inches.

Figure 4:
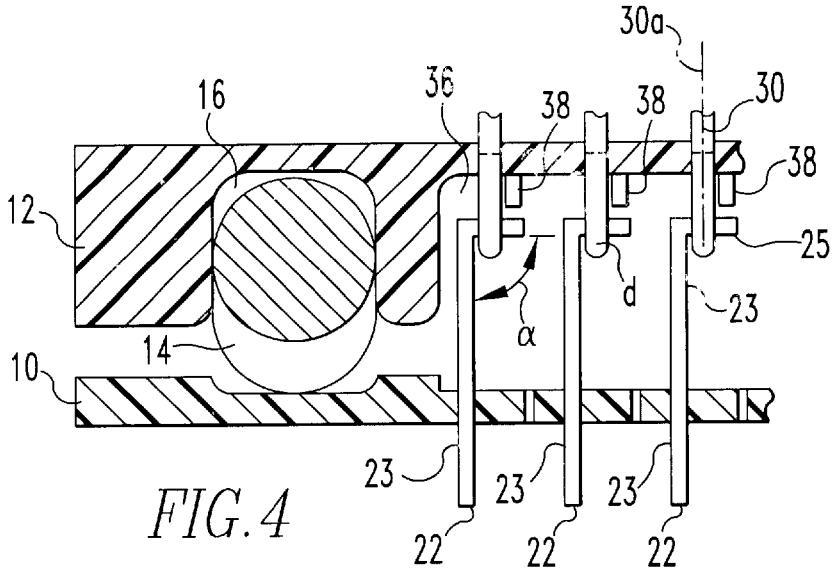
FIG. 4 shows an enlarged cross-sectional view of a preferred embodiment of a PGA socket according to the invention in an open position.

FIG. 4 shows an enlarged cross-sectional view of a preferred embodiment of a PGA socket 100 in an open position. As shown in FIG. 4, the beam portions 23 of the contacts 22 extend through the base 10 to connect electrically with, for example, plated apertures in a circuit substrate (not shown). In a preferred embodiment, the contacts 22 are interference fit within the base 10 and freely supported thereby. With the socket 100 in an open position, the pins 30 of an IC can be inserted through insertion holes 20 in cover 12 and apertures 27 in contacts 22 without being forcibly pressed against, or even engaging, the contacts 22.

In the embodiment shown in FIG. 4, the camming surfaces 17 of the actuator 14 are formed so that when actuator bar 18 is in an open position, the cover 12 is made to move slightly away from the base 10 (e.g., in the direction shown by arrow 28*b* in FIG. 1). Preferably, a relief space 36 is provided between the contacts 22 and the cover 12. For each contact 22, cover 12 includes a deflection member 38 that extends into the relief space, from the inside face of the cover 12. As shown in FIG. 4, a deflection member 38 can be located above each contact near a distal end of the contact mating portion 25 (i.e., the end opposite the contact beam 23), so that the pins 30 are between the deflection members and the contact beam 23.

Figure 5:
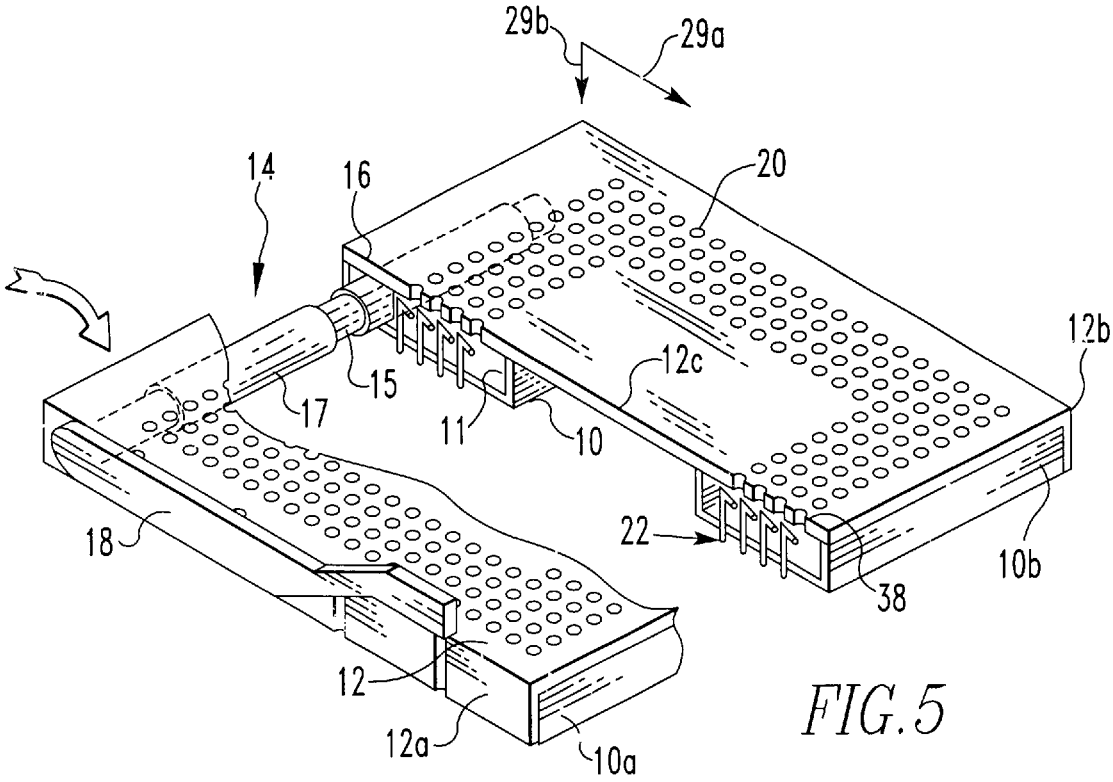
FIG. 5 shows a partial cross-section of a PGA socket according to the invention in a closed position.
Figure 6:
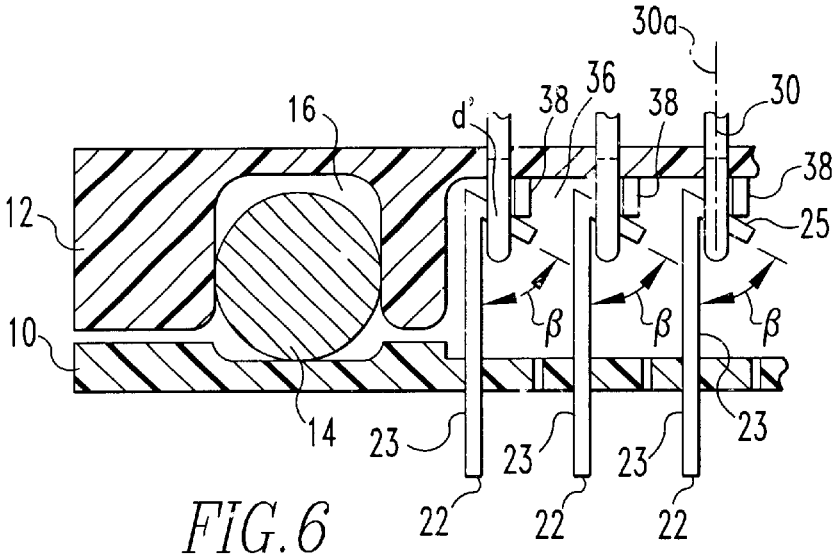
FIG. 6 shows an enlarged cross-sectional view of a preferred embodiment of a PGA socket according to the invention in a closed position.

FIG. 5 shows a partial cross section, and FIG. 6 shows an enlarged cross section, of a PGA socket 100 in a closed position. Again, depending on the eccentricity of the camming surfaces 17, when the actuator bar 18 is moved from its open position to its closed position (as shown in FIG. 5), the camming surfaces 17 rotate (shown in FIG. 4 as being clockwise) to exert a force against the walls that define opening 16, thereby causing the cover 12 to move in a direction depicted by arrow 29*a* generally parallel to the base 10 and in a direction depicted by arrow 29*b* generally perpendicular to the base 10.

Figure 7:
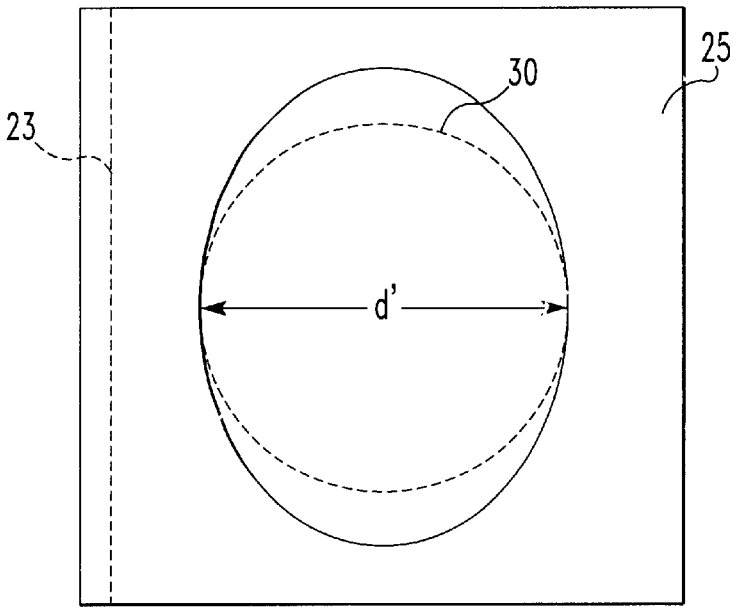
FIG. 7 provides a detailed top view of a contact according to the invention in a closed PGA socket.

As shown in FIG. 6, as the cover 12 moves toward the base 10 (with pins 30 previously inserted into the insertion holes 20), the deflection members 38 push on the distal portions of the corresponding contact mating portions 25, resiliently bending the contact mating portions 25 relative to the beam portions 23. Upon fill rotation of actuator bar 18, contact mating portion 25 forms an angle $\beta$ with beam portion 23, where angle $\beta$ is smaller than angle $\alpha$. The arrangement of contact mating portion 25 when socket 100 is in a closed position creates an effective diameter d' of the aperture 27 that is smaller than its true diameter d when socket 100 is in an open position (see FIG. 7). The effective diameter d' of the aperture 27 is measured perpendicular to the pin axis 30*a* of the pin 30 inserted into the aperture 27. As contact mating portion 25 moves out of perpendicularity with pin axis 30*a*, effective diameter d' decreases so that pin 30 eventually makes contact with contact mating portion 25. Thus, when socket 100 is in a closed position, contact 22 should complete an electrical connection between pin 30 and the circuit substrate.

Figure 8A:
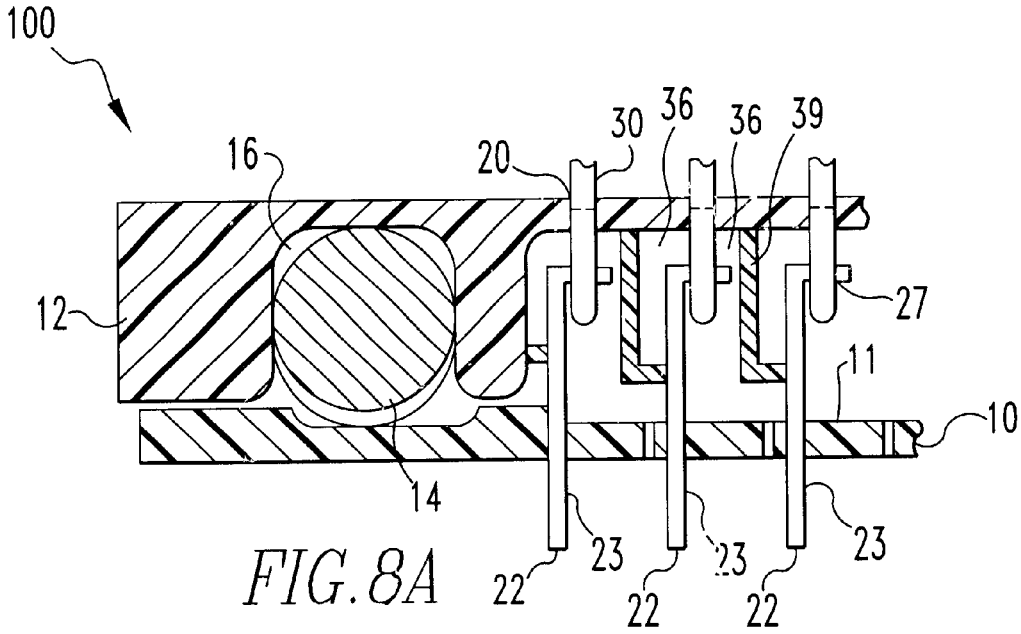
FIGS. 8A and 8B show enlarged cross-sectional views of another preferred embodiment of a PGA socket according to the invention in open and closed positions, respectively.

FIG. 8A shows an enlarged cross-sectional view of another preferred embodiment of a PGA socket 100 in an open position. In the embodiment shown in FIG. 8A, the camming surfaces 17 of the actuator 14 are formed so that when the actuator bar 18 is in an open position, the cover 12 is made to slide along the base 10 (in the direction shown by arrow 28*a* in FIG. 1). Preferably, a relief space 36 is provided between the contacts 22 and the cover 12. For each contact 22, cover 12 includes a deflection member 39 that extends into the relief space, from the inside face of the cover 12. As shown in FIG. 8A, a deflection member 39 can be located proximate each contact beam portion 23, so that the contact beams 23 are between the pins 30 and the deflection members 39. The deflection members 39 resiliently bend beam portions 23 when the cover 12 is moved along base 10 from an open position to a closed position. Similarly to the aforementioned embodiment, bending contact 22 reduces the effective diameter of aperture 27 to make electrical contact with pin 30.

Figure 8B:
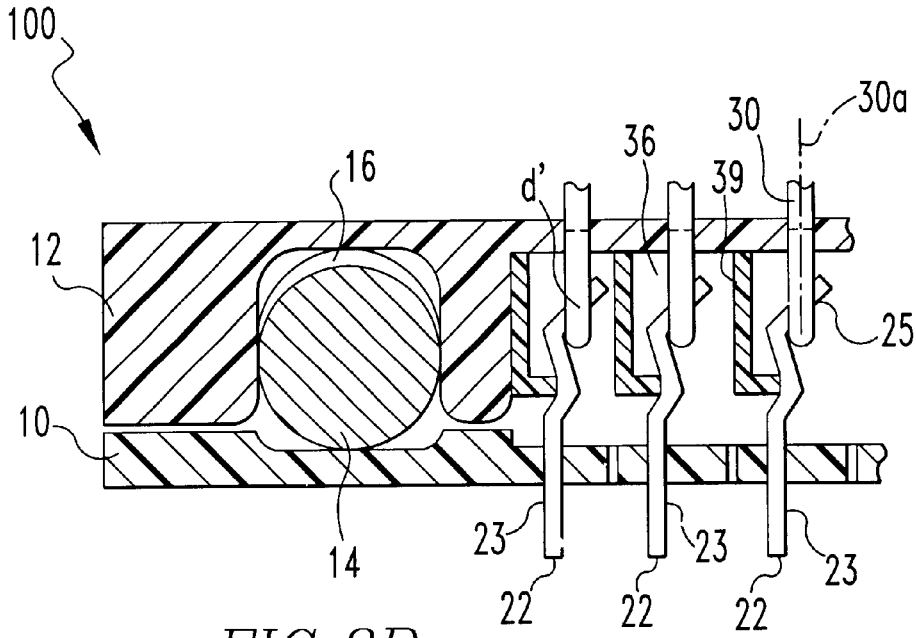

FIG. 8B shows an enlarged cross-sectional view of the PGA socket 100 of FIG. 8A in a closed position. In this embodiment, when the actuator bar 18 is moved from its open position to its closed position (as shown in FIG. 5), the camming surfaces 17 rotate (in a clockwise direction in the embodiment shown in FIG. 8A) to provide a force against the walls forming opening 16. This causes cover 12 to slide along base 10 in the direction of arrow 29*a*.

As shown in FIG. 8B, as cover 12 moves along base 10 (with pins 30 previously inserted into insertion holes 20), deflection members 38 push on the beam portions 23 of the corresponding contacts 22. This force causes the beam portions 23 to bend toward the pins 30. This force, along with the movement of pins 30 toward, and eventually into electrical contact with, an edge of aperture 27, causes contact plates 25 to rotate relative to pins 30. The force is applied to the beam portion 23 as the socket 100 is being closed, at which point the contact mating portion 25 is in electrical contact with the pin 30 as shown. Once again, the effective diameter, d', of the aperture 27 (i.e., the diameter of the aperture 27 measured perpendicular to the pin axis, 30*a*), is smaller than its true diameter, d (see FIG. 7). Thus, as the beam portion 23 is bent, the contact mating portion 25 moves out of perpendicularity with the pin axis 30*a*. The effective diameter, d', decreases so that pin 30 eventually makes electrical contact with the contact mating portion 25. Thus, contact 22 completes an electrical connection between pin 30 and the circuit substrate.

Figure 9A:
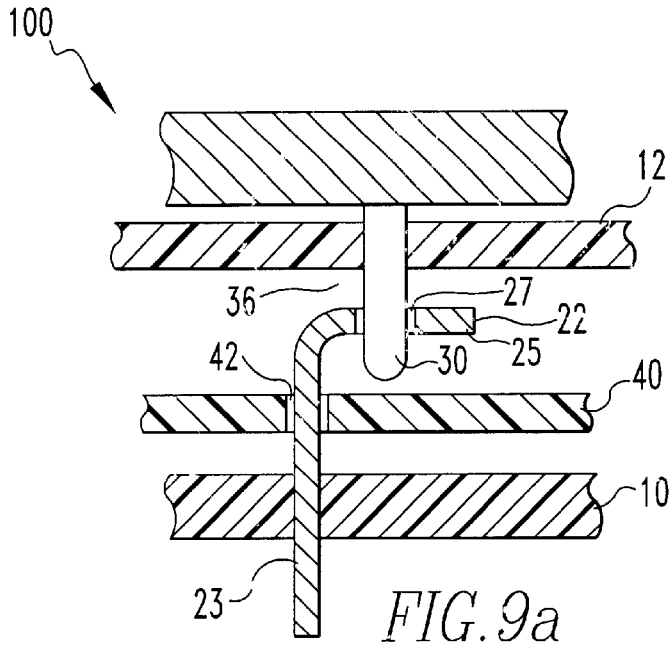
FIGS. 9A and 9B shows enlarged cross-sectional views of yet another preferred embodiment of a PGA socket according to the invention in open and closed positions, respectively.

FIG. 9A shows an enlarged cross-sectional view of yet another preferred embodiment of a PGA socket 100 in an open position. A deflection member 40 extends between generally stationary cover 12 and base 10. Preferably, a relief space 36 is provided between the contacts 22 and the cover 12. Deflection member 40 is basically parallel to base 10, and perpendicular to the beam portions 23 of contacts 22. Deflection member 40 includes a plurality of apertures 42. A contact 22 extends through each aperture 42 and into base 10. Deflection member 40 is disposed between contact mating portion 25 and base 10 and can be moved independently of cover 12 and base 10. Thus, deflection member 40 can be moved generally parallel to cover 12 and base 10 and along a direction perpendicular to beam portions 23 of contacts 22. As deflection member 40 is moved relative to cover 12 and base 10, deflection member 40 resiliently bends beam portions 23. Similarly to the aforementioned embodiment, bending contact 22 rotates contact mating portion 25 (in a counter-clockwise direction in the embodiment shown in FIG. 9B), and reduces the effective diameter of aperture 27 to make electrical contact with pin 30.

Figure 9B:
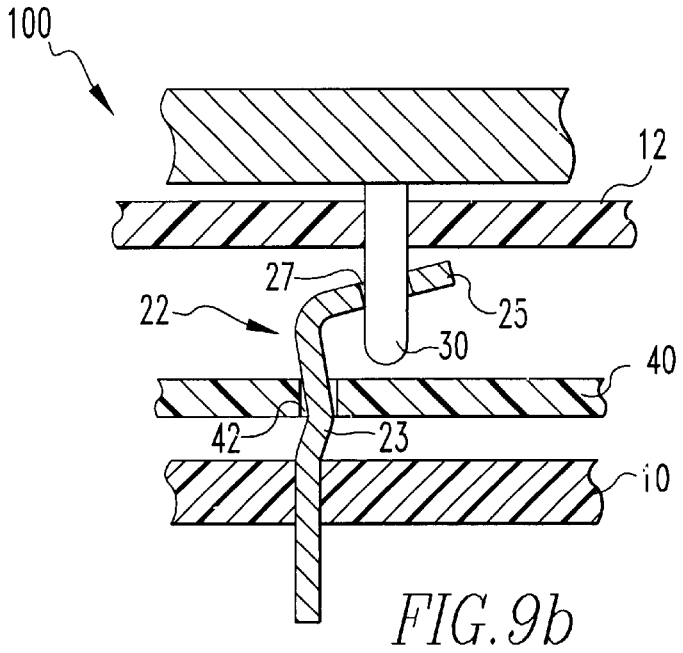

FIG. 9B shows an enlarged cross-sectional view of the PGA socket 100 of FIG. 9A in a closed position. In this embodiment, when the actuator bar 18 is moved from its open position to its closed position (as shown in FIG. 5), the camming surfaces 17 rotate to cause deflection member 40 to move in the direction of arrow 29*a*.

As shown in FIG. 9B, as deflection member 40 moves relative to cover 12 and base 10 (with pins 30 previously inserted into insertion holes 20), deflection member 40 pushes on the beam portions 23 of contacts 22. This force causes the beam portions 23 to cant toward the pins 30 until the side wall of aperture 27 engages pin 30. Further movement of deflection member 40 causes beam portion 23 to bow, rotating contact mating portion 25 so that the opposite side of aperture 27 engages pin 30. The force is applied to the beam portion 23 as the socket 100 is being closed, at which point the contact mating portion 25 is in electrical contact with the pin 30 as shown. Once again, the effective diameter, d', of the aperture 27 (i.e., the diameter of the aperture 27 measured perpendicular to the pin axis, 30*a*), is smaller than its true diameter, d (see FIG. 7). Thus, as the beam portion 23 is engaged, the contact mating portion 25 moves out of perpendicularity with the pin axis 30*a*. The effective diameter, d', decreases so that pin 30 eventually makes electrical contact with the contact mating portion 25. Thus, contact 22 completes an electrical connection between pin 30 and the circuit substrate.

Those skilled in the art will appreciate that numerous changes and modifications may be made to the preferred embodiments of the invention and that such changes and modifications may be made without departing from the spirit of the invention. It is therefore intended that the appended claims cover all such equivalent variations as fall within the true spirit and scope of the invention.

I claim:

1. A socket for connecting to a circuit substrate an electrical component having a terminal extending along a terminal axis therefrom, the socket comprising:

a base;

a contact secured to the base to electrically connect the terminal to the circuit substrate, the contact comprising a beam portion having a length, and a contact mating portion at an angle with the beam portion and having a contact aperture therein to receive the terminal;

a cover, attached to the base, that has a lead-in aperture for receiving the terminal and allowing the terminal to enter the contact aperture; and a deflection member for causing the contact mating portion to rotate relative to the terminal axis and to engage the terminal at a first location and at a second location that is opposite the first location and proximate the beam portion, wherein the deflection member has an aperture through which the beam portion extends, for causing the contact mating portion to rotate relative to the terminal axis when the deflection member is moved relative to the beam portion.

2. The socket of claim 1, wherein the contact aperture has a generally circular cross-section.

3. The socket of claim 1, wherein the beam portion has a generally uniform cross-sectional area along the entire length thereof.

4. A socket connector for receiving terminals from a mating electrical component, the socket comprising:

a base;

a cover engaging said base and having apertures therein for receiving the terminals;

a plurality of stamped contacts secured to said base, each of said contacts having a mating portion with an opening therein for receiving a corresponding one of the terminals;

an actuator for moving one of said cover and said contacts along an actuation direction from a first position, in which said openings accept the terminals, to a second position, in which said openings engage the terminals at a first location and at a second location opposite said first location along said actuation direction, and a deflection member having an aperture through which the contacts extend, for causing the mating portions of the contacts to rotate relative to terminal axes of respective terminals when the deflection member is moved relative to the contacts.

5. A socket for connecting to a circuit substrate an electrical component having a terminal extending along a terminal axis therefrom, the socket comprising:

a base;

a contact secured to the base to electrically connect the terminal to the circuit substrate, the contact comprising a beam portion having a length, and a contact mating portion at an angle with the beam portion and having a contact aperture therein to receive the terminal, wherein the contact aperture has a generally circular cross-section;

a cover, attached to the base, that has a lead-in aperture for receiving the terminal and allowing the terminal to enter the contact aperture; and a deflection member for causing the contact mating portion to rotate relative to the terminal axis and to engage the terminal at a first location and at a second location that is opposite the first location and proximate the beam portion.

6. The socket of claim 5, wherein the deflection member extends from an inner surface of the cover proximate the lead-in aperture.

7. The socket of claim 6, wherein the deflection member extends from the inner surface of the cover, for causing the contact mating portion to rotate relative to the terminal axis when the cover is moved along the base.

8. The socket of claim 6, wherein the deflection member has an aperture through which the beam portion extends, for causing the contact mating portion to rotate relative to the terminal axis when the deflection member is moved relative to the beam portion.

9. The socket of claim 6, wherein the beam portion has a generally uniform cross-sectional area along the entire length thereof.

* * * * *